US005476123A

United States Patent [19]

Rydin

[11] Patent Number: 5,476,123

[45] Date of Patent: Dec. 19, 1995

[54] PAPERMAKING FABRIC SEAM WITH SEAM FLAP OR EXTENSION

[75] Inventor: Björn Rydin, Halmstad, Sweden

[73] Assignee: Nordiskafilt AB, Halmstad, Sweden

[21] Appl. No.: 75,477

[22] PCT Filed: Dec. 17, 1991

[86] PCT No.: PCT/SE91/00867

§ 371 Date: Jun. 18, 1993

§ 102(e) Date: Jun. 18, 1993

[87] PCT Pub. No.: WO92/11412

PCT Pub. Date: Jul. 9, 1992

[30] Foreign Application Priority Data

Dec. 21, 1990 [SE] Sweden ..... 9004162

[51] Int. Cl.[6] ..... D03D 13/00

[52] U.S. Cl. ..... 139/383 AA; 428/193; 428/234

[58] Field of Search ..... 428/234, 193; 139/383 AA, 425 A

[56] References Cited

U.S. PATENT DOCUMENTS 3,815,645 6/1974 Codorniu .
4,182,381 1/1980 Gisbourne ..... 139/383 AA
4,824,525 4/1989 Penven ..... 139/383 AA
4,863,786 9/1989 Green et al. ..... 139/383 AA X
4,896,702 1/1990 Crook ..... 139/383 AA

FOREIGN PATENT DOCUMENTS 355389 4/1973 Sweden .

*Primary Examiner*—Andrew M. Falik
*Attorney, Agent, or Firm*—Kane, Dalsimer, Sullivan, Kurucz, Levy, Eisele and Richard

[57] ABSTRACT

A woven fabric, such as a base fabric for a press felt, which is designed for a papermaking machine or the like has along each one of two end edges a plurality of seam loops to be included in a loop seam to form an endless woven fabric. The fabric is characterized in that there is provided, at least at one of the end edges, at least one string of material, preferably in the form of one or more extra yarn threads, extended substantially parallel to the above-mentioned one end edge adjacent the regular thread system of the fabric. The extra yarn thread or threads are woven to only such portions of the seam loops as are facing a first side of the fabric, preferably the paper side thereof. In this manner, there is formed in the seam zone a type of extension of the regular thread system of the fabric, whereby the loop seam is conformed to the rest of the fabric to avoid markings in a paper web at the loop seam.

9 Claims, 8 Drawing Sheets

PAPERMAKING FABRIC SEAM WITH SEAM FLAP OR EXTENSION

BACKGROUND OF THE INVENTION

The present invention generally relates to a woven fabric which is designed for use in a papermaking, cellulose or board manufacturing machine and which along each one of two end edges has a plurality of loops to be included in a loop seam to form an endless woven fabric. The invention also relates to a method of manufacturing such a fabric.

More specifically, the invention provides an improvement of such a loop seam by conforming it to the rest of the woven fabric, so as to avoid markings in a paper web at the loop seam.

The woven fabric according to the invention is particularly useful, but by no means exclusively so, as a base fabric in a press felt for the press section of a papermaking machine. Press felts are manufactured either with or without a seam. Present-day Joining techniques rely almost exclusively on a so-called loop seam, where two fabric edges (not necessarily of the same fabric) to be joined together each have one row of seam loops. These loops are inclined or orthogonal to the principal plane of the fabric. When joining together the two fabric edges, the loops on one edge are inserted between the loops of the other edge, whereupon at least one separate seam thread is inserted in the interlaced seam loops to lock them to one another.

Such a loop seam is however not entirely satisfactory for several reasons, which will be given hereinafter with reference to FIGS. 1–7 illustrating a woven fabric of the prior art, a method of manufacturing a fabric, as well as the shortcomings of this prior art.

FIG. 1 is a vertical cross-section taken parallel to warp threads in an embodiment of a known double-layered woven fabric, and FIG. 2 is a section taken along the line II—II in FIG. 1. The woven fabric in FIG. 1 has warp threads V1, V2, V3, V4 extended in the plane of the drawing sheet, and weft threads 1–8 extended orthogonally to the plane of the drawing sheet and distributed in two layers L1, L2. The warp threads V1–V4 are crimped around the relatively straight weft threads 1–8, each warp thread, such as the warp thread V1, cyclically following the pattern "over→between→ underΔbetween" with respect to the two layers L1, L2 of weft threads (see also FIG. 8 to the left of plane A).

FIG. 3 schematically shows a method of weaving the double-layered fabric in FIGS. 1 and 2 with a so-called round weaving technique, where seam loops 11, 11' of the above-mentioned type are woven simultaneously with the fabric. The weft in FIG. 3 is woven in the order 1→2→2'→1'. The weft threads 1 and 2 in the so-called top cloth form the seam loop 11 around a seam thread 10 parallel to the warp threads. The weft threads 1' and 2' in the so-called bottom cloth form the seam loop 11' around the same seam thread 10. At the transition to the left in FIG. 3 between the top cloth and the bottom cloth, the weft forms an irregularity at the loom edge.

FIG. 4 schematically shows on a larger scale the seam loop 11 with the seam thread 10 removed, and the four warp threads V1–V4 located closest to the loop 11.

FIG. 5 schematically shows a finished loop seam between the end edges of a double-layered woven fabric according to FIGS. 1–4. As described above, the seam loops 11, 11' are formed by weaving the weft threads 1–8 around the seam thread 10. The seam thread 10 used during the weaving procedure and hereinafter referred to as "weaving seam thread", may typically have a diameter of 1.2–1.7 mm. The weaving seam thread is removed from the seam loops before the woven fabric is mounted in the papermaking machine. For the final joining of the seam in the papermaking machine, use is however normally made of a seam thread 10 of slightly smaller diameter, e.g. 0.7 mm, to enable it to be passed easily through the loops. The area around the final loop seam (FIG. 5) will therefore have a larger void as compared with the seam formed directly in the loom (FIG. 3). This increased void is illustrated in FIG. 5, where the seam zone consists of regions O1, O2, O1, where O2 is the region occupied by the seam thread 10 of the final loop seam, and the two regions O1, O1 on each side of the O2 region representing the part of the loops 11, 11', respectively, which gives rise to said increased void of the seam zone. In FIG. 6, which illustrates the seam of FIG. 5 in a still more simplified view, the woven fabric composed of the warp threads and the weft threads are generally designated 20.

The following problems P1–P4 are encountered in the prior art:

P1 The seam zone does not have the same water permeability as the rest of the woven fabric because the seam loops 11, 11' have in the O1 areas a larger void than the rest of the fabric. If the fabric is used as a base fabric in a press felt, this may lead to an undesired marking on the paper web, being plastic during pressing, as a result of different dewatering in the seam zone.

P2 If the woven fabric is used as a base fabric in a press felt which on its paper side (i.e. the side facing the paper web during operation) has a relatively compressible top layer of a batt needled to the base fabric, the batt will become anchored less efficiently in the seam zone (O1-O2-O1) with a consequent risk that it may easily be worn away and undesired markings may occur in the paper web.

P3 The increased void of the seam zone in the O1 areas results in higher air permeability, entailing the following problems. If the poorly anchored batt portion as stated under P2 above is designed according to FIG. 7 as a flap 22 covering the seam zone (this technique is described in SE 8206222-5), this batt flap 22 will, when the seam zone of the press felt passes a dewatering suction box (not shown) disposed on the batt side of the felt, whip into the suction box, producing a pistol-shot-like sound, and be subjected to wear, as schematically illustrated by the dash-dot lines in FIG. 7.

P4 When a press felt with a base fabric according to FIG. 5 passes a press nip, there will occur at the seam zone a variation in compressibility, producing a marking in the paper. From FIG. 5 appears that the thickness of the base fabric in the seam zone (O1-O2-O1) is $2\times\Delta T$ less than the thickness T of the rest of the fabric, where $\Delta T$ corresponds to the warp thread diameter which is e.g. 0.4 mm. A batt layer on the paper side of the base fabric will therefore exhibit a reduced thickness in the press nip. The increased voids within the seam loops at the O1 regions also contributes to the compressibility variation.

FIG. 5 indicates by dashed lines at 26 a known technique for reducing the void in the regions O1 of the seam zone. After the woven fabric has been joined together by means of the seam thread 10 in the papermaking machine, one or more filling yarn threads 26 are passed through the seam loops in the regions O1. The use of such threads 26 reduces to some extent the problems P1 and P3 stated above (relating to deviating water and air permeability, respectively). The use of filling yarn threads does however not solve problem P2 (poor batt anchorage), since the threads 26 are inserted after the needling of the batt, or problem P4 (reduced thickness), since the filling yarn threads 26 are completely within the seam loops 11, 11' and therefore cannot eliminate the thickness reduction 2×ΔT. Moreover, the filling yarn threads pose per se an additional problem (P5), because the technique is time-consuming, which is especially serious in a papermaking machine where downtime is highly detrimental for cost-efficiency reasons.

It appears from the above that the O1 regions of the seam zone are undesirable. Reducing the O1 regions by making the seam thread 10 for the final joining of the seam thicker is however no viable solution to the problem. First, the seam thread will become difficult or impossible to insert when Joining the fabric ends together in the papermaking machine. Second, a seam thread which is too thick may entail an unacceptably high density in the O2 region. This is because the seam thread in itself is thicker than the warp threads and because the weft density normally is twice as high in the O2 region, since the loops in this region are interlaced side by side against each other.

SUMMARY OF THE INVENTION

A general object of the invention is to solve the problems P1–P5 specified above.

A main object of the invention is to make it possible to produce a markingless loop seam in a woven fabric for a papermaking machine.

A special object of the invention is to provide a loop seam of this type which, in relation to the rest of the fabric, does not exhibit a deviating water permeability, deviating batt anchorage capacity, deviating air permeability or deviating compressibility.

A further object of the invention is to provide a loop seam of the above type which permits the use of a relatively thin seam thread, making it easy to connect the seam loops to each other.

These and other objects are achieved according to a first aspect of the invention by means of a woven fabric of the type stated in the introduction to this specification, which is characterised in that there is provided, at least at one of said end edges, at least one string of material, preferably an extra yarn thread, which is extended substantially parallel to said end edge adjacent the regular thread system of the fabric and which is joined, preferably woven, to only such portions of the seam loops as are facing a first side of the fabric.

By using such a string of material, preferably by weaving one or more such extra yarn threads into the loops, there is formed in the seam zone a kind of extension of the regular thread system of the fabric. The thickness of this extension is however less than the thickness of the rest of the fabric, for which reason the seam loops, despite the presence of the extension, become easily accessible when the seam thread or threads should be inserted.

The extra yarn thread or threads are preferably woven to only such portions of the seam loops as are facing the paper side of the fabric, which means its side facing the paper web during operation.

Preferred embodiments of the woven fabric of the invention are stated in the dependent claims.

According to a second aspect of the invention, there is provided a method of manufacturing a woven fabric of the type stated in the introduction to this specification, which is characterised by the step of continuously weaving, as the fabric is being woven, at least in one end edge of the fabric, at least one extra yarn thread which is arranged substantially parallel to said one end edge adjacent the regular thread system of the fabric and which is woven to only such portions of the seam loops which, after completion of said loop seam, are facing a first side of the fabric. Preferably, at least one such extra yarn thread is woven in both end edges of the fabric.

In the case where the woven fabric is double-layered with two layers of weft threads joined together by warp threads, and the loops are formed by the weft threads in that these threads, when passing from one layer to the other, are passed around one or more seam threads, the weaving of the extra yarn thread or threads in the seam loops can be effected as follows. The extra yarn thread or threads are arranged in the loom on the side of the seam thread or threads facing away from the fabric, i.e. on the side facing away from the regular warp threads. If, during weaving, the weft threads are passed around both the seam thread and the extra yarn thread or threads, and the extra yarn thread or threads are guided by the same shaft motions as the regular warp threads, the extra yarn thread or threads will slide around some of the seam loops during the weaving procedure to be collected in one of the layers.

Other preferred embodiments of the method of the invention are stated in the dependent claims.

BRIEF DESCRIPTION OF THE DRAWINGS

The invention will now be described in more detail some embodiments with reference to the accompanying drawings, in which FIGS. 8–15 illustrate the invention.

FIG. 1 is a vertical cross-section taken parallel to warp threads in a known double-layered woven fabric.

FIG. 2 is a section taken along the line II—II in FIG. 1.

FIG. 3 schematically illustrates a known method of manufacturing the fabric in FIGS. 1 and 2 by round weaving technique.

FIG. 4 shows a broken-away part, including a seam loop, of a known woven fabric manufactured according to FIG. 3.

FIG. 5 schematically shows a completed loop seam according to known technique.

FIG. 6 is a simplified view of the known loop seam in FIG. 5.

FIG. 7 illustrates a permeability problem encountered in a known press felt.

FIG. 8 is schematic perspective view of a broken-away part of an embodiment of a woven fabric of the invention during the manufacture thereof.

FIG. 9 is similar to FIG. 6, but modified in accordance with the invention.

FIG. 10 illustrates a method of Joining together a woven fabric according to the invention.

FIG. 13 illustrates a method of weaving a fabric according to the invention with four extra yarn threads.

FIG. 14 shows a variant of the method in FIG. 13.

FIG. 15 schematically shows a completed loop seam obtained by the weaving method illustrated in FIG. 13 or 14.

The same reference numerals as in FIGS. 1–7 are used for equivalent parts in FIGS. 8–15, where possible.

DESCRIPTION OF PREFERRED EMBODIMENTS

Figure 1:
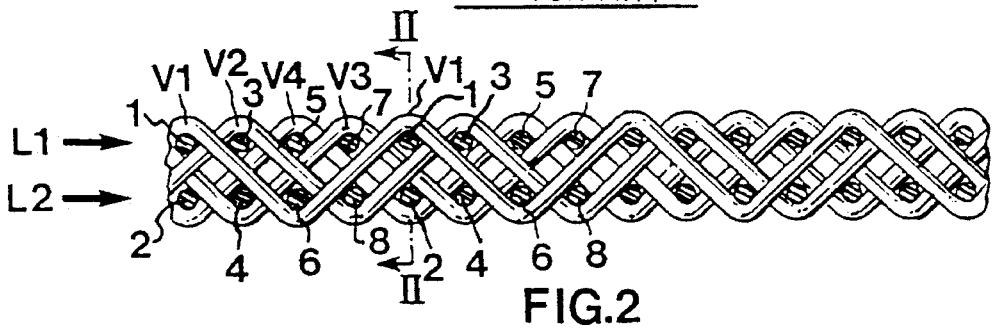
FIG.1 PRIOR ART
FIGS. 1–7 illustrate the prior art described above.
Figure 2:
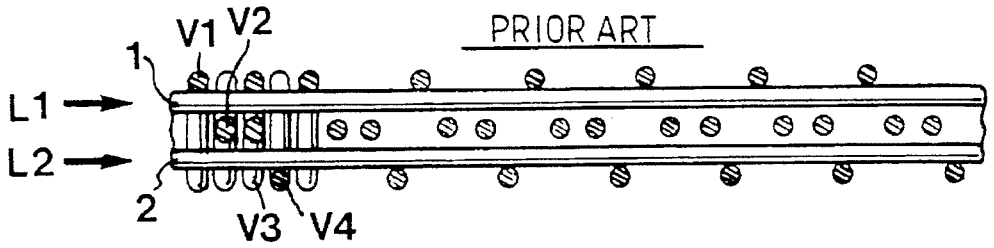
FIG.2 PRIOR ART
Figure 3:
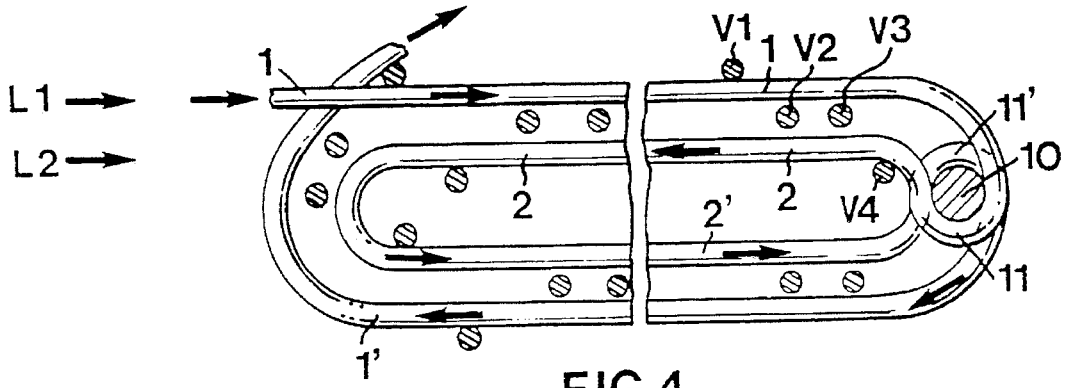
FIG.3 PRIOR ART
Figure 4:
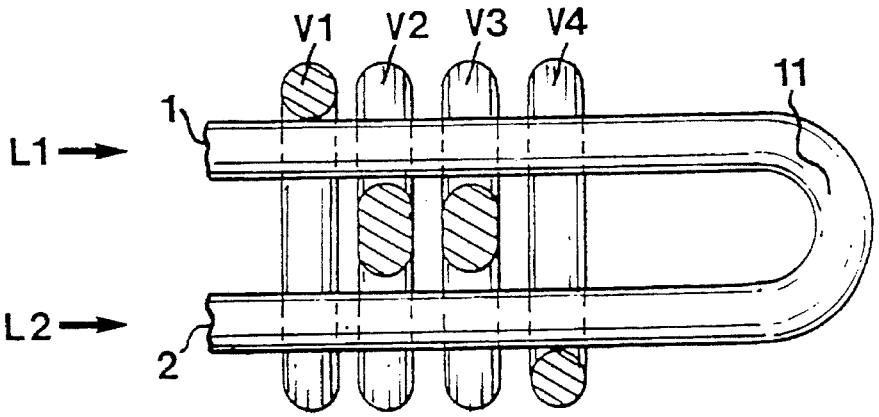
FIG.4 PRIOR ART
Figure 7:
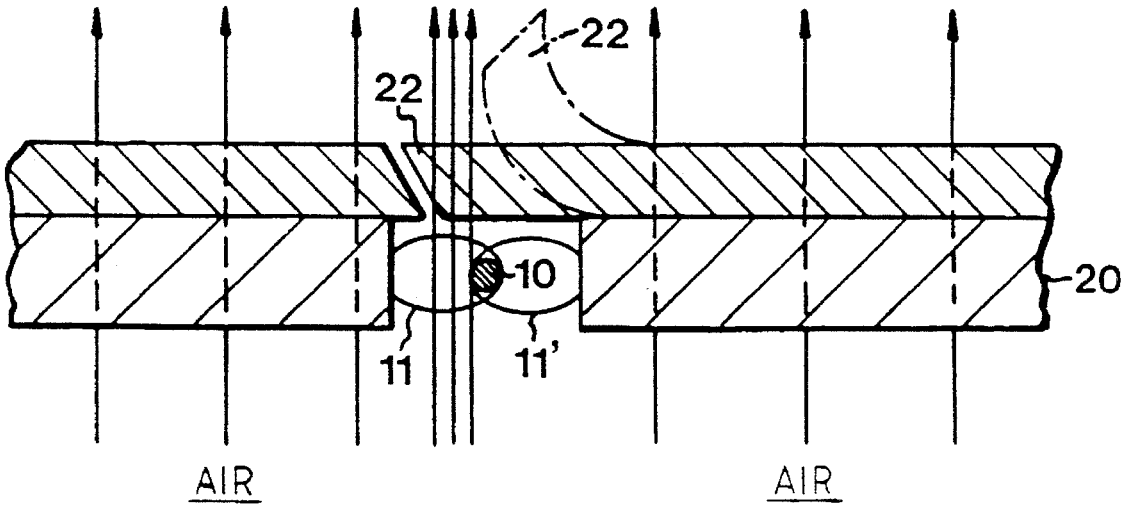
FIG. 7 PRIOR ART
Figure 8:
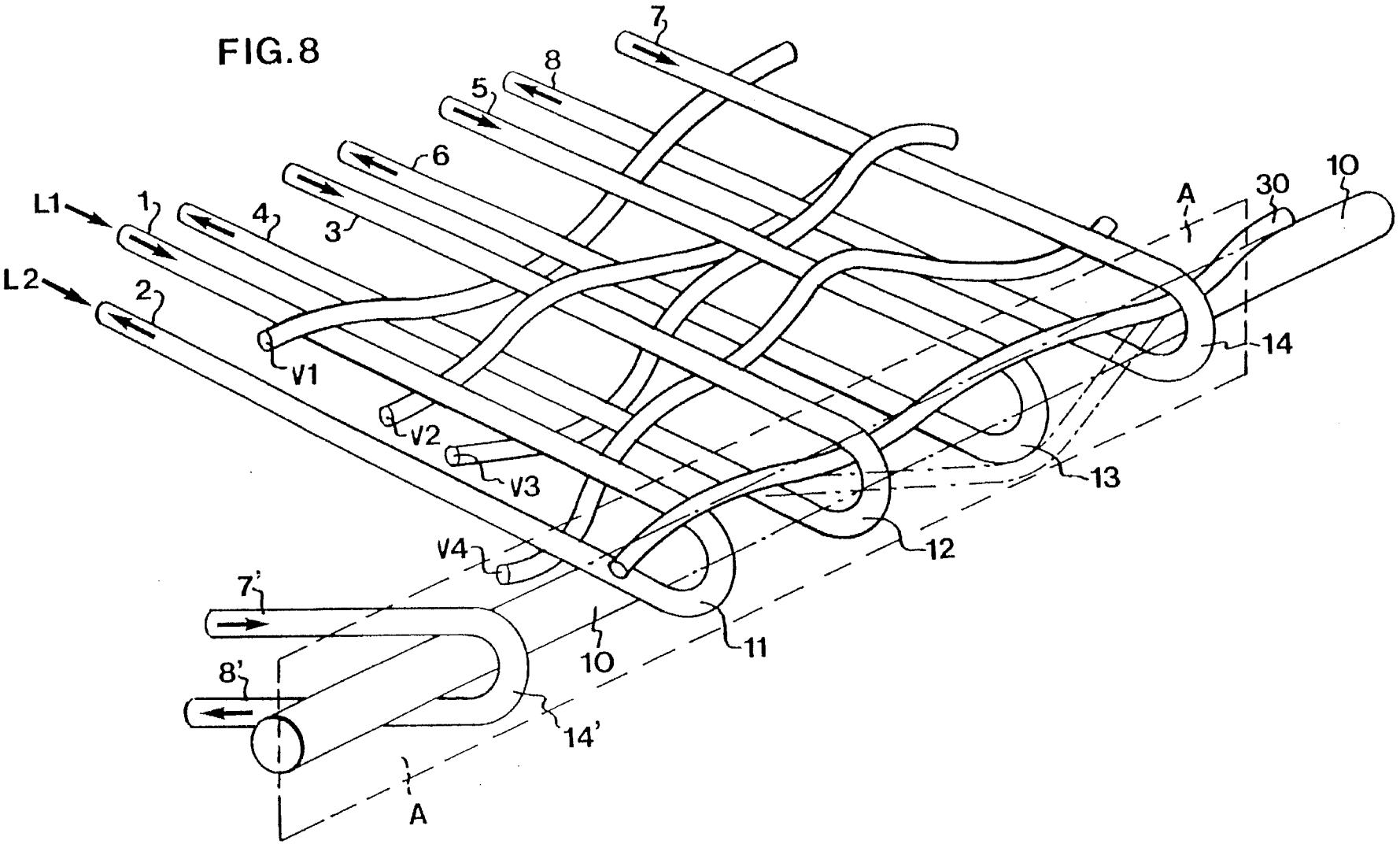

In FIG. 8, which is a broken-away schematic perspective view of a woven fabric manufactured according to the invention, the dash-dot lines indicate a plane A extending through a weaving seam thread 10 of the type described with reference to FIG. 3. The part of the fabric in FIG. 8 to the left of the plane A is previously known, and its structure and manufacture by round weaving technique have been described above with reference to FIGS. 1–7 and will therefore not be described again.

In FIG. 8, to the right of the plane A, there are shown four seam loops 11, 12, 13 and 14, all of which have been woven around the seam thread 10 and are formed, in said order, by the weft threads 1, 2; 3, 4; 5, 6; and 7, 8, respectively. The four warp threads V1–V4, the eight weft threads 1–8, as well as the four seam loops 11–14 all form part of the top cloth. The bottom cloth is represented in FIG. 8 only by two weft threads 7' and 8' and an associated seam loop 14', it being however understood that the bottom cloth is woven in the same way as the top cloth and that seam loops (not shown) in the bottom cloth are woven between the seam loops 11–14 of the top cloth. The woven fabric of FIG. 8 is so far previously known.

FIG. 8 shows how an extra yarn thread 30 has been woven around the seam loops 11–14 according to an embodiment of the invention. More specifically, the extra yarn thread is woven only to the "top layer L1" of the seam loops 11–14, which is formed by the extensions of the weft threads 1, 3, 5 and 7 to the right of the plane A. Thus, the extra yarn thread 30 does not bind to the extension, to the right of the plane A, of the bottom layer L2 (weft threads 2, 4, 6 and 8) of the top cloth. As a result, the regular thread system of the woven fabric to the left of the plane A is extended to the right of this plane A, however only in the top layer L1 of the top cloth.

A corresponding extra yarn thread (not shown) is preferably also woven in the bottom cloth of the fabric, such that both end edges of the fabric are provided with such an extra yarn thread. In the bottom cloth, this extra yarn thread would, for example in the loop 14', bind to the extension of the weft thread 8', but not to the extension of the weft thread 7'.

Figure 9:
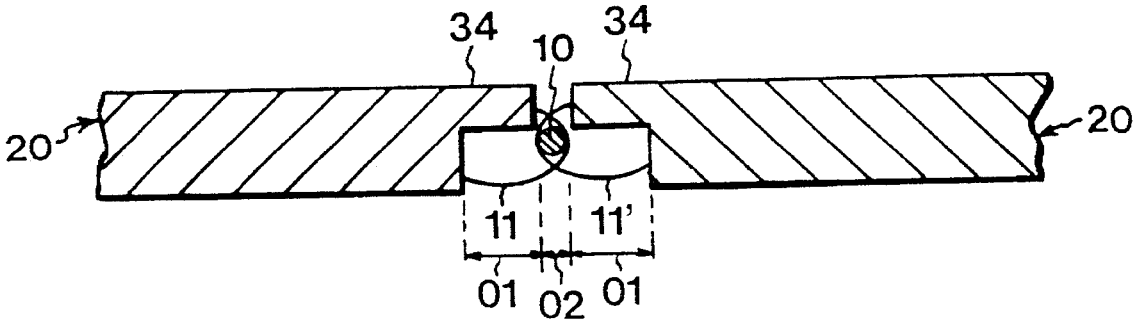

FIG. 9 schematically shows the appearance of a completed loop seam in a woven fabric according to FIG. 8, both end edges of which are formed with such an extension, as at 34 in FIG. 9. From a comparison with FIG. 6, it appears that these extensions 34 efficiently contribute to conform the seam zone to the rest of the woven fabric. Especially, the above-mentioned regions O1 (FIG. 5) are bridged in the top layer of the fabric.

It should be emphasised that FIG. 9 is highly schematic and that the relative dimensions of the fabric 20, the seam thread 10, the extensions 34 and the regions O1 and O2 may in practice deviate quite considerably from what is shown in FIG. 9. In practice, it is found, for example, that the top side of the woven fabric becomes practically completely even in the seam zone, without any thickness reduction in the O2 region as indicated in FIG. 9.

Figure 10:
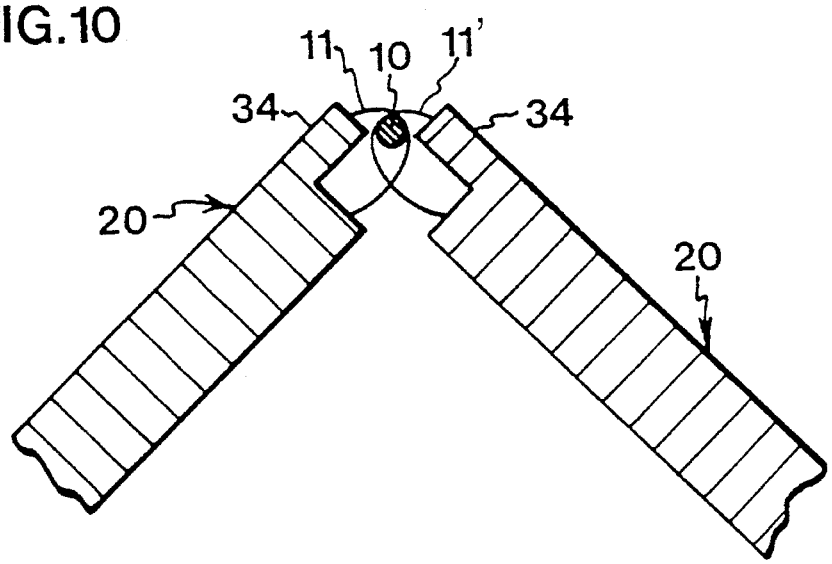

FIG. 10 illustrates how the two end edges of the fabric, despite the provision of the extensions 34, can be joined together at an angle to each other in customary manner, for interlacing the seam loops sufficiently to permit the insertion of the seam thread or threads. Although it is possible to provide corresponding extensions of the bottom layer of the fabric, this would cause problems in joining together the fabric, if this is done as shown in FIG. 10.

One way of inserting an extra yarn thread 30 of the type shown in FIG. 8 will now be described.

Although it is theoretically possible to insert the extra yarn thread 30 after completing the weaving, it should, in practice, be inserted while the fabric is woven in the loom. A first alternative is to rely on shaft guidance, independent of the warp shafts, of the extra yarn thread 30, which can then be inserted either to the right or to the left of the plane A in FIG. 8.

Figures 12A, 12B, 12C, 12D:
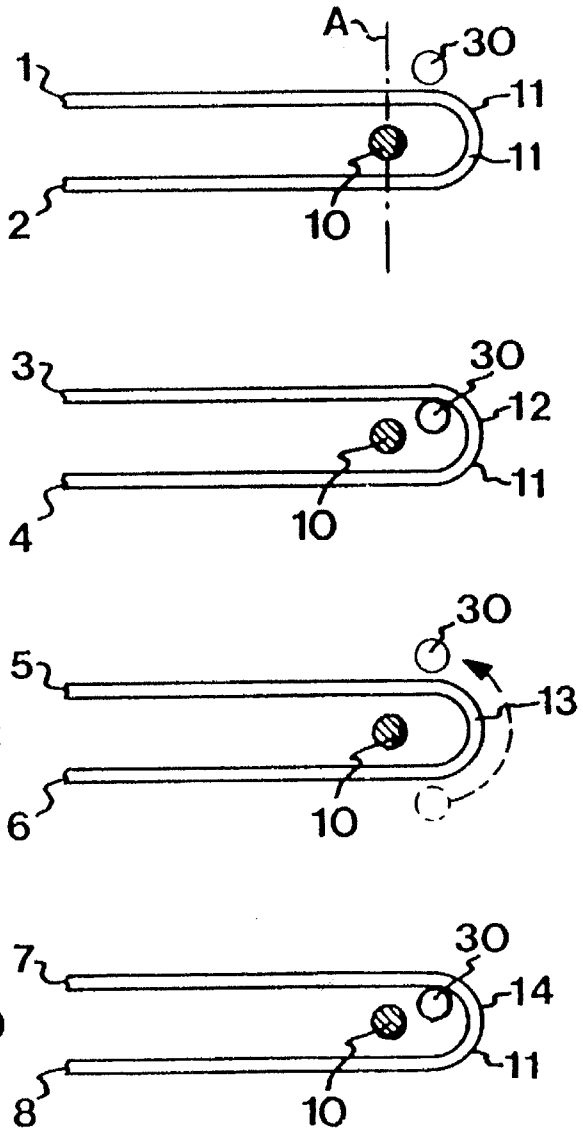
FIGS. 11A–11D and FIGS. 12A–12D jointly illustrate a preferred method of manufacturing a woven fabric according to the invention.
Figures 11A, 11B, 11C, 11D:
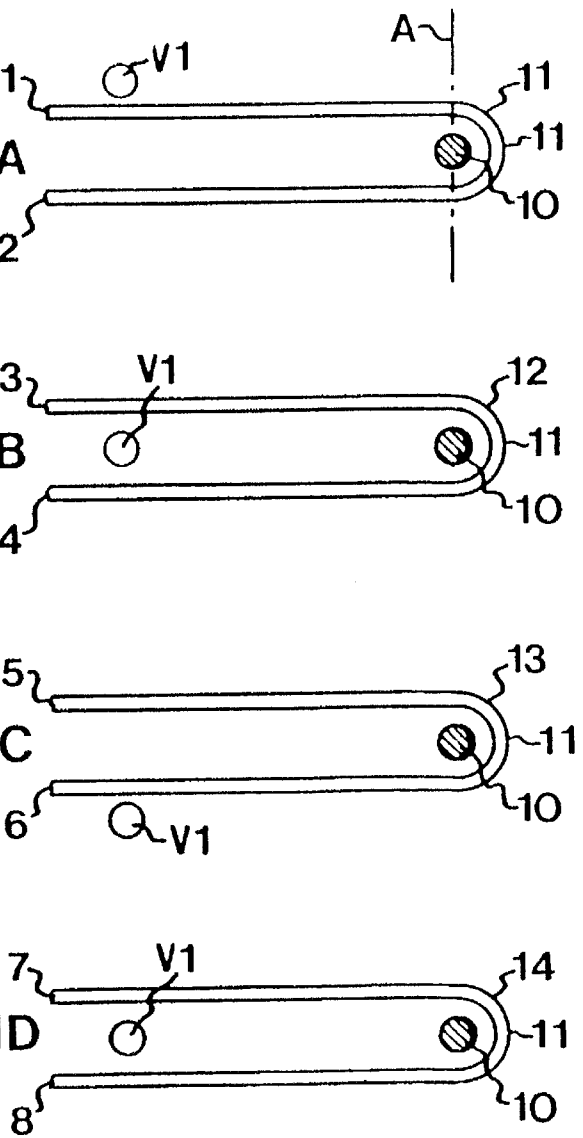

Another, more advantageous alternative will now be described with reference to FIGS. 11A–D and 12A–D. FIGS. 11A–D show how the warp thread V1 in FIG. 8 is bound to the weft threads 1–8. The warp thread V1 is "over" in FIG. 11A, "between" in FIG. 11B, "under" in FIG. 11C, and finally again "between" in FIG. 11D. The other warp threads V2–V4 follow the same structure, being however offset from V1 (see FIG. 8). The warp threads V1–V4 are guided in known manner by means of vertically movable shafts. Assuming now that an extra yarn thread 30 is inserted to the right of the plane A as an "extra warp thread" and that this extra warp thread 30 is guided by the same shaft motion as the warp thread V1 in FIGS. 11A–11D, then the result becomes as shown in FIGS. 12A–D. Like the warp thread V1, the extra yarn thread 30 will first be situated "over" (FIG. 12A) and then "between" (FIG. 12B). When, in the third step (FIG. 12C), the extra yarn thread 30 is guided by the shaft so as to be placed under the third loop 13, the extra yarn thread 30, and this should be especially noted, will not bind to the extension of the weft thread 6, but instead slides upwards around the loop 13 to a position on the upper side thereof, i.e. substantially to the same position as the extra yarn thread 30 in FIG. 12A. This sliding movement of the extra yarn thread 30 up around the loop 13 also appears from FIG. 8 where the initial position of the thread is indicated by dash-dot lines. For the last weft threads 7 and 8, the extra yarn thread 30, like the warp thread V1, is located "between" in FIG. 12D.

One reason why the extra yarn thread 30 slides upwards in FIG. 12C, but not downwards in FIG. 12A, is that a loop 12' (not shown) of the bottom cloth is located between the loops 12 and 13 of the top cloth. This bottom cloth loop 12' has already been woven when the shaft guides the extra yarn thread downwards in FIG. 12C. Hence, the bottom cloth loop 12' prevents the extra yarn thread 30 from being positioned entirely under the top cloth loop 13, resulting in that the extra yarn thread 30 will not bind to the underside of the loop 13, but instead slides up around the loop 13. A contributory reason is that warp threads for the top cloth must be lifted relatively far when the bottom cloth is to be woven, in order not to be inserted in the bottom cloth. Of course, the fact that the extra yarn thread 30, like the warp threads V1–V4, is held tensioned during the weaving procedure also is a contributory factor.

Figure 13:
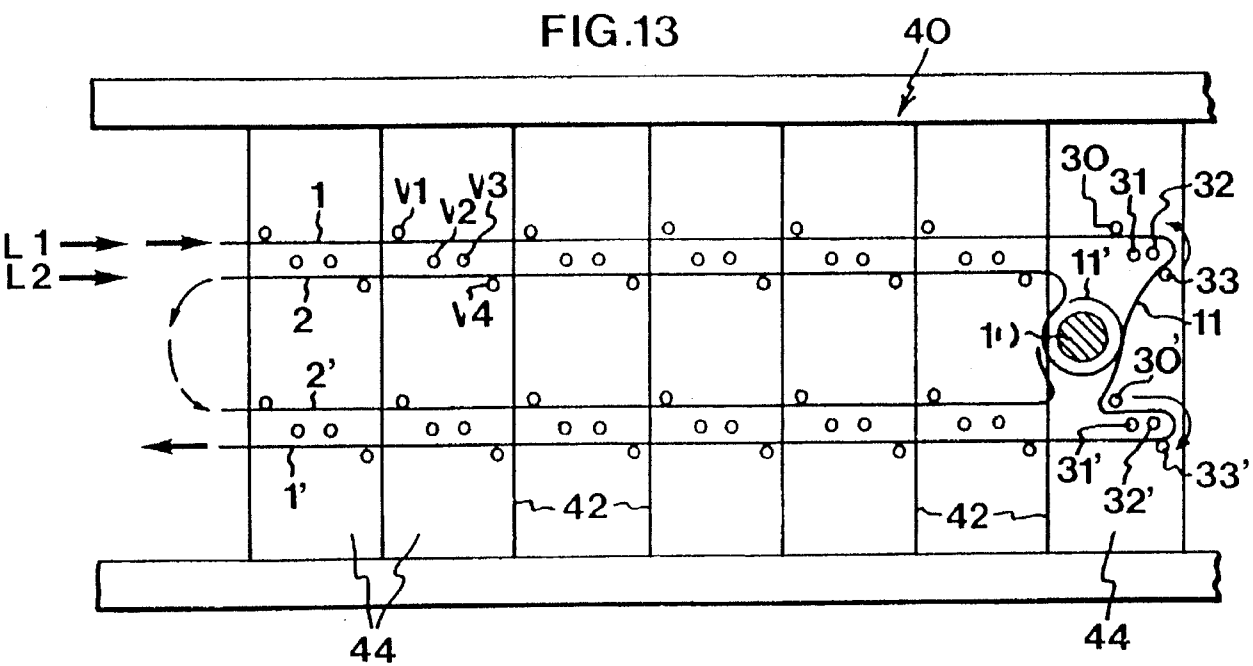

FIG. 13 schematically shows a part of a loom and how more than one extra yarn thread can be inserted according to the invention.

Reference numeral 40 in FIG. 13 generally designates a reed having a number of vertical reed wires 42. The space between two wires is traditionally termed "dent", designated 44 in FIG. 13. Each dent 44 accommodates eight warp threads, four for the top cloth and four for the bottom cloth. The warp threads are guided upwards and downwards by heddles (not shown). Four extra yarn threads 30–33 are provided for the top cloth, and four extra yarn threads 30'–33' (FIG. 13) are provided for the bottom cloth. All of these eight extra yarn threads are arranged in the same dent 44 as the weaving seam thread 10 around which the seam loops 11, 11' are woven.

FIG. 13 illustrates, for example, that the extra yarn thread 33 in the top cloth and the extra yarn thread 30' in the bottom cloth will not bind in the respective weft thread or loop portion, but will instead slide upwards and downwards, respectively, as indicated by arrows.

If many or thick extra yarn threads should be inserted, it may be preferred to place them in another dent than the weaving seam thread 10. One example hereof is illustrated in FIG. 14, otherwise corresponding to FIG. 13.

Figure 5:
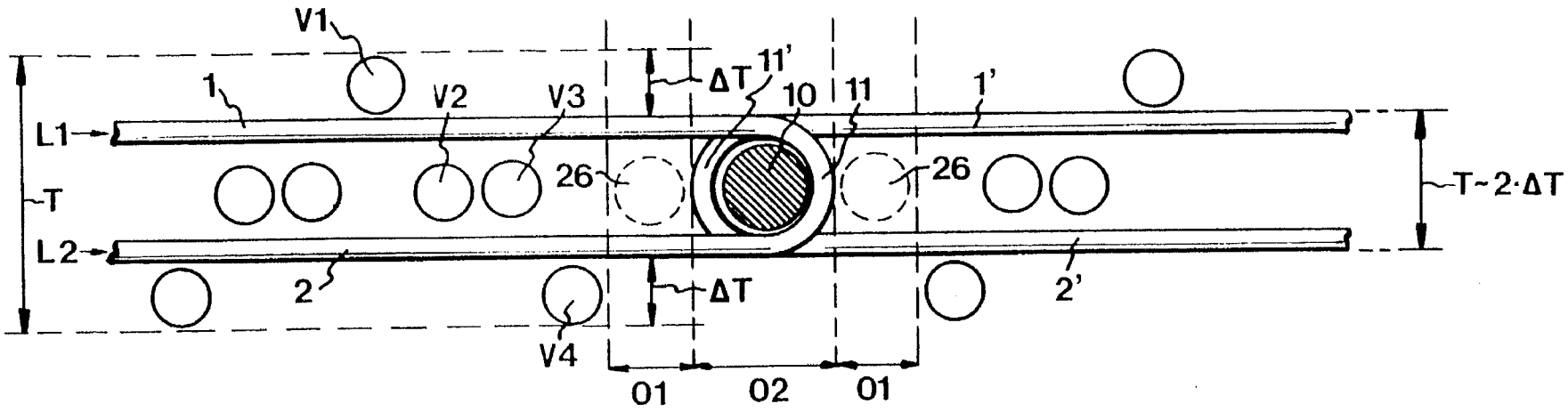
FIG. 5 PRIOR ART
Figure 6:
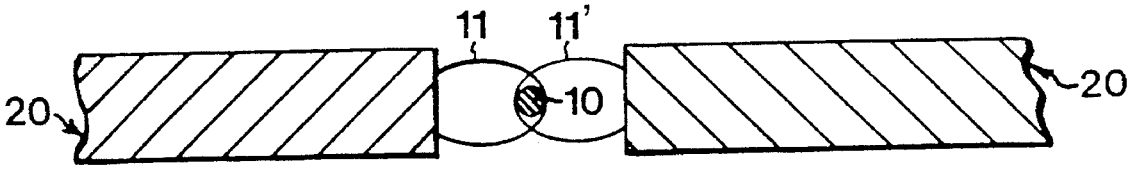
FIG.6 PRIOR ART
Figure 14:
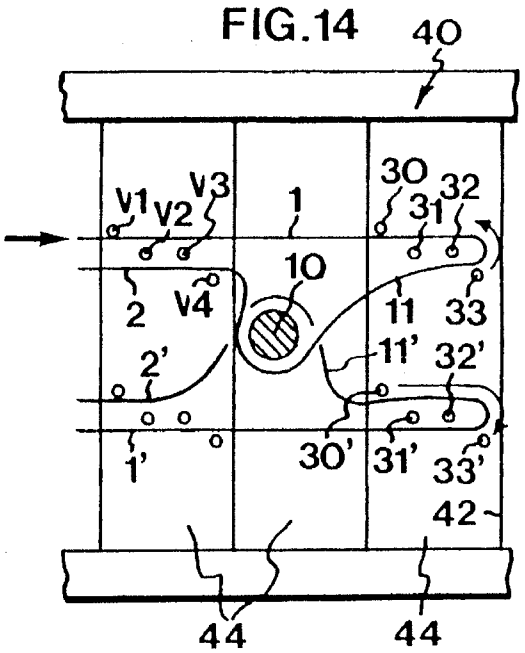
Figure 15:
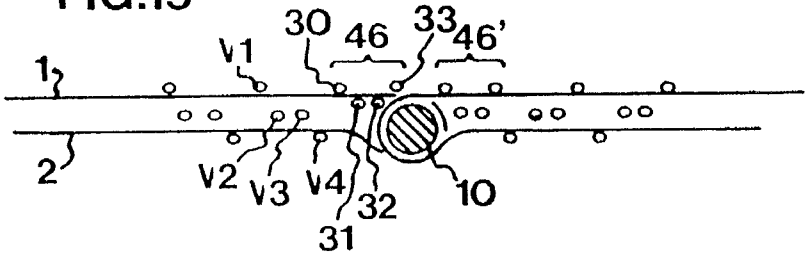

FIG. 15 shows a finished loop seam in a woven fabric manufactured according to FIG. 13 or 14 (basically the same final result is achieved with both alternatives of FIGS. 13 and 14), reference numerals 46, 46' corresponding to the regions occupied by the extra yarn threads 30–33 and 30'–33', respectively, and can be compared to the above-mentioned O1 regions of the prior art in FIG. 5.

The invention having now been described by illustrating embodiments, it is understood that many different modifications and variants are conceivable within the scope of the accompanying claims.

For example, the invention is not only applicable to the base fabric in press felts, but can also be used other woven fabrics, such as drying fabrics, in a making machine.

In round weaving, the fabric can also be manufactured, as is well-known in the art, with two loop seams, one at each loom edge where the bottom cloth passes into the top cloth. In this case, extra yarn threads can be woven into both seam zones.

Further, the fabric need not be manufactured by round weaving technique, and the seam loops may also be of the type spliced in afterwards in a flat-woven fabric. This technique is also usable for single-layered fabric or for multi-layered fabric having more than two layers.

Figure 16:
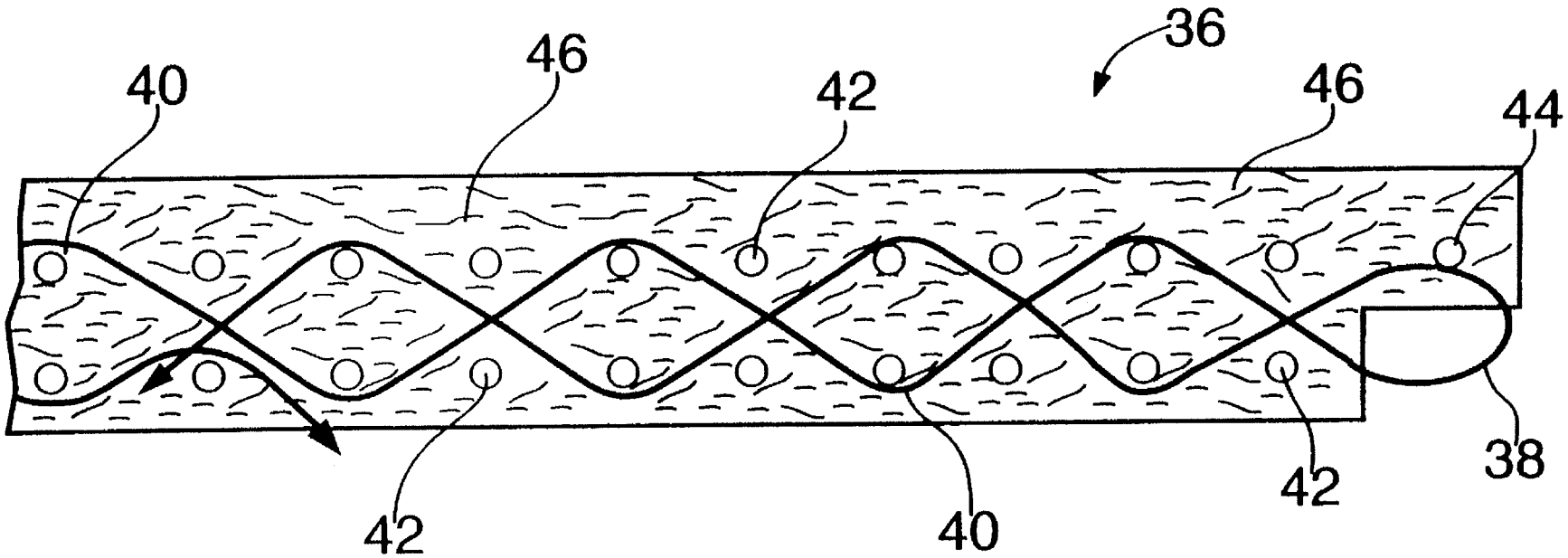
FIG. 16 shows a flat-woven fabric incorporating the present invention.

For example, FIG. 16 shows a flat-woven fabric incorporating the present invention. Fabric 36 includes seam loop 38 formed by warp yarn 40, which is woven back into the end of fabric 36. The fabric 36 also includes two layers of weft yarns 42. Extra weft yarn 44, substantially parallel to weft yarns 42, is interwoven with seam loop 38 on the top portion thereof. Compressible fiber layer 46 is anchored to the thread system of fabric 36 comprising the interwoven warp yarns 40, weft yarns 42 and extra weft yarn 44.

As to the choice of extra yarn threads, these may, for example, consist of melting yarn to provide by heating a more efficient fiber anchorage. The term "melting yarn" comprises yarn partly consisting of material with a lower melting point in relation to other parts of the yarn. Different extra yarn threads may also consist of different materials, it being also possible to use different numbers of extra yarn threads on two adjoining fabric edges, which may be preferable when making an oblique cut through a batt layer, as shown in FIG. 7.

The term "yarn" as used herein comprises any yarn type, e.g. spun yarn, monofilament yarn, plied monofilament yarn, etc.

Further, the weave pattern may be varied in many different ways as compared with that shown in FIG. 8.

The invention can also be used for base fabric designs having more than two layers, either woven as a single piece or laminated, the seam/seams being then effected as described above in the two lowermost layers of the base fabric, and longitudinal threads in upper layers extending uninterrupted over the seam to be cut open together with a batt flap of the type shown at 22 in FIG. 7 to form part thereof. In such an application, invention improves the anchorage of cut-open fabric layers in lower fabric layers in that needled and through-needled batt is anchored in the extra yarn thread or threads.

I claim:

1. A woven fabric for a papermaking, cellulose or board manufacturing machine, said fabric being woven from a longitudinal thread system and a transverse thread system, and having a first side for supporting fibrous web material to be dewatered, said fabric comprising:

a plurality of seam loops provided along each one of two end edges of the fabric and to be included in a loop seam to form an endless woven fabric, said seam loops being formed by said threads of said longitudinal thread system, and said loop seam being formed by directing a pintle through a passage formed by interdigitating said seam loops at said two end edges with one another; and, at least at one of said end edges, at least one string of material, which is extended substantially parallel to said at least one end edge adjacent said transverse thread system of the fabric and which is joined to only such portions of said seam loops as are facing said first side of the fabric by interweaving with said threads of said longitudinal thread system forming said seam loops only on said first side of said fabric, wherein said portions of the seam loops are located at a distance—seen in a direction of thickness of the fabric from a main surface of the fabric which is located on said first side, and wherein said string of material bridges said distance to form an extension of said main surface.

2. A fabric as claimed in claim 1, wherein said string of material comprises at least one extra yarn thread woven to said portions of the seam loops.

3. A fabric as claimed in claim 1, wherein said first side of the fabric is a paper side thereof.

4. A fabric as claimed in claim 1, wherein said threads of said longitudinal thread system are distributed in two layers joined together by said seam loops and said threads of said transverse thread system interconnect said two layers of longitudinal threads, said layer of said two layers of longitudinal threads closest to said first side of the fabric including said portions of the seam loops.

5. A fabric as claimed in claim 1, wherein said string of material is substantially parallel to warp threads in said transverse thread system of the fabric.

6. A fabric as claimed in claim 1, wherein said string of material is substantially parallel to weft threads in said transverse thread system of the fabric.

7. A fabric as claimed in claim 1, wherein the fabric comprises a relatively incompressible base fabric in a press felt, and wherein the fabric on said first side is joined to a relatively compressible fiber layer intended to face a paper web during operation, said fiber layer being anchored to said regular thread system of the fabric and to portions of the seam loops which are joined to said string of material.

8. A fabric as claimed in claim 1, wherein said string of material is made from a meltable material.

9. A fabric as claimed in claim 1, wherein said string of material is made from at least two extra yarn threads which are extended substantially parallel to said at least one end edge adjacent said transverse thread system of the fabric, all of said extra yarn threads being woven to only said portions of the seam loops facing said first side of the fabric.

* * * * *